US005498198A

United States Patent [19]

Kogure

[11] Patent Number: 5,498,198

[45] Date of Patent: Mar. 12, 1996

[54] GRINDING MACHINE

[75] Inventor: Toshiharu Kogure, Narashino, Japan

[73] Assignee: Seiko Seiki Kabushiki Kaisha, Japan

[21] Appl. No.: 97,713

[22] Filed: Jul. 27, 1993

[51] Int. Cl.[6] ..... B24B 3/46

[52] U.S. Cl. ..... 451/146; 451/160; 451/41

[58] Field of Search ..... 51/283 R, 48 R, 51/51, 56 R, 131.1, 132, 165.75; 451/41, 140, 146, 160, 285, 290, 9

[56] References Cited

U.S. PATENT DOCUMENTS

| | | | |
|---|---|---|---|
| 4,337,599 | 7/1982 | Koide et al. | 51/165.87 |
| 4,564,000 | 1/1986 | Stern et al. | 51/283 R |
| 4,584,796 | 4/1986 | Yoneda et al. | 51/165.87 |
| 4,953,522 | 9/1990 | Vetter | 51/325 |
| 5,010,692 | 4/1991 | Ishida et al. | 51/283 R |
| 5,097,632 | 3/1992 | Yamamuri et al. | 51/165.87 |
| 5,185,965 | 2/1993 | Ozaki | 51/48 R |

*Primary Examiner*—Bruce M. Kisliuk
*Assistant Examiner*—Derris Banks
*Attorney, Agent, or Firm*—Adams & Wilks

[57] ABSTRACT

A grinding machine comprises a table movably disposed on a fixed base to undergo reciprocal movement relative to the fixed base along a reciprocating axis. A first shaft is rotatably disposed on the table to undergo rotation relative to the table about a first axis extending perpendicular to the reciprocating axis. A workpiece holder is connected to the first shaft for rotation therewith. A workpiece having a work surface is connected to the workpiece holder for rotation therewith. A second shaft is rotatably supported for rotation about a second axis extending at an inclination angle to the first axis, and is supported for reciprocal movement towards and away from the workpiece along the second axis. A grinder having a grinding surface is connected to the second shaft for rotation therewith and for reciprocal movement of the grinding surface towards and away from the work surface of the workpiece.

20 Claims, 2 Drawing Sheets

GRINDING MACHINE

BACKGROUND OF THE INVENTION

This invention relates to a grinding machine which grinds a flat surface of a circular wafer-shaped work or the like/ using a grinding stone, in which it is especially intended that the work can be ground with a good degree of flatness and its surface roughness is improved.

In the prior art, when a flat surface of a circular wafer-shaped work or the like is ground as a grinding surface, the creep feed grinding as shown in FIG. 3(*a*) or the work rotation grinding as shown in (b) in the same figure has been carried out.

By the way, in the creep feed grinding, in a state in which a grinding surface A of a work W is subjected to face-contact with an end face of a cup type grinding stone 10, have the work W reciprocate toward the shaft center side of the grinding stone while have the grinding stone 10 rotate around its shaft center. Using such reciprocal movement of the work W, it is made that the cup type grinding stone 10 grinds the grinding surface A of the work W. In addition, in the work rotation grinding, the grinding surface A of the work W is subjected to face-contact with the end face of the cup type grinding stone 10 by a certain length L, and in a state in which the contact length L is fixed, have the work W and the grinding stone 10 rotate around each of the shaft centers, respectively. Using such rotation of the work W and the grinding stone 10, it is made that the grinding stone 10 grinds the grinding surface A of the work W.

However, in the conventional creep feed grinding as described above, since the reciprocal movement of the work W is used to make the grinding stone 10 to grind the grinding surface A of the work W, the contact length L between the grinding stone and the work becomes shortest when the grinding stone is located at the outer peripheral portion of the work, and on the contrary, the contact length L becomes longest when the grinding stone passes through the central portion of the work, so that not only the grinding load which is inflicted to a grinding stone shaft (not shown) through the grinding stone changes depending on periodic change of the contact length, but also since the grinding stone 10 always contacts with the work W in the state of face-contact in the creep feed grinding, the grinding load inflicted to the grinding stone shaft as described above is relatively large and which bends and deforms the grinding stone shaft, therefore it is difficult to grind the grinding surface of the work with a good degree of flatness.

On the other hand, also in the conventional work rotation grinding, in the same manner as the creep feed grinding, since the grinding stone 10 always contacts with the work W in a state of face-contact, the grinding load inflicted to the grinding shaft through the grinding stone is relatively large and which bends and deforms the grinding stone shaft, so that it is difficult to grind the grinding surface of the work with a good degree of flatness.

Moreover, in the work rotation grinding, the contact length L between the grinding stone 10 and the work W is fixed in a state of being relatively long, and a grinding amount by one grinding stone particle of the grinding stone is large, so that especially when a grinding stone of fine grinding stone particles is used, grinding burning of the work takes place due to the clogging of the grinding stone. Therefore, the grinding particle size of the grinding stone has certain restriction with respect to the diameter of the grinding surface, and only a grinding stone of grinding stone particles having a large diameter not less than the restriction can be used, and it is impossible to improve the surface roughness of the grinding surface.

SUMMARY OF THE INVENTION

It is an object of this invention to provide a grinding machine with which a work can be ground with a good degree of flatness, and the improvement in its surface roughness can be also contemplated.

In order to achieve the above-mentioned object, this invention is characterized by providing; a reciprocating table which reciprocates rightward and leftward, a main shaft which is arranged on the reciprocal table and installed substantially perpendicularly with respect to the movement direction of the reciprocating table, a chuck which is attached to the forward end of the main shaft and fixes a work during grinding, a grinding stone shaft which is arranged to be inclined with respect to a grinding surface of the work fixed to said chuck, a cup type grinding stone which is attached to the forward end of said grinding stone shaft so as to mutually face said chuck, and a taper-shaped conical portion which is formed by cutting out a part of an outer peripheral face at the forward end of the cup type grinding stone and capable of abutting to the grinding surface of said work.

According to this invention, when the work which is fixed to the chuck is ground, the grinding surface of the work is ground while the conical portion of the cup type grinding stone always contacts to the work in a state of line-contact.

BRIEF DESCRIPTION THE DRAWINGS

DETAILED DESCRIPTION OF THE PREFERRED EMBODIMENTS

One embodiment of the grinding machine according to this invention will be explained hereinafter in detail using FIG. 1 and FIG. 2.

Figure 1:
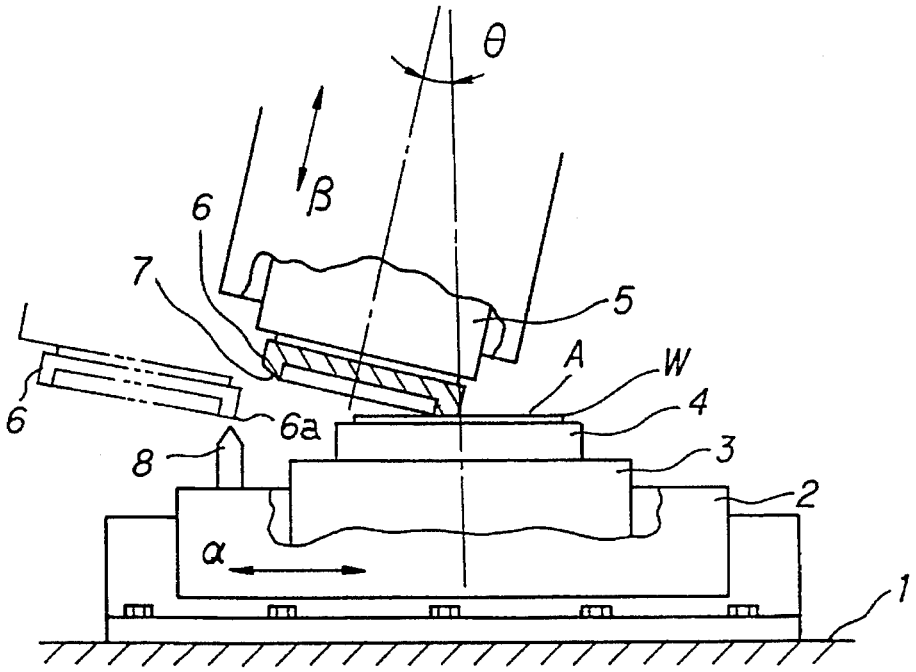
FIG. 1 is a partially broken front view of the grinding machine according to this invention.

As shown in FIG. 1, this grinding machine is provided with a reciprocating table 2 on a base 1, and the reciprocating table 2 is constituted to reciprocate rightward and leftward through a table feed mechanism not shown in the figure.

In addition, a main shaft 3 is contained in the above-mentioned reciprocating table 2, besides the main shaft 3 is supported in a manner capable of rotation around its shaft center, it is installed substantially perpendicularly with respect to the movement direction of the reciprocating table 2 (the direction of the arrow (α) in the figure).

Further, a chuck 4 for fixing a circular wafer-shaped work W is integrally attached to the forward end of the main shaft 3 as described above. The chuck 4 is constituted to have a chuck face which is porous to suck and fix the work W by vacuum.

By the way, a grinding stone shaft 5 is provided at the forward end side of the above-mentioned chuck 4, and the grinding stone shaft 5 is installed to be inclined with respect to the flat surface of the work W fixed to the chuck 4, that is the grinding surface A of the work W, and is constituted to move along the shaft center direction (the direction of the arrow (β) in the figure) through a cutting feed mechanism not shown in the figure.

Incidentally, it is most preferable that the inclination angle θ of the grinding stone shaft 5 is within a range of not more than 5 degrees. In addition, when the grinding stone shaft 5 is designed, because the inclination of the grinding stone shaft 5 is within a range of not more than 5 degrees, the moment which affects the radial rigidity is about 10% of the total load, so that it is allowable that only the thrust rigidity is mainly considered.

Figure 2:
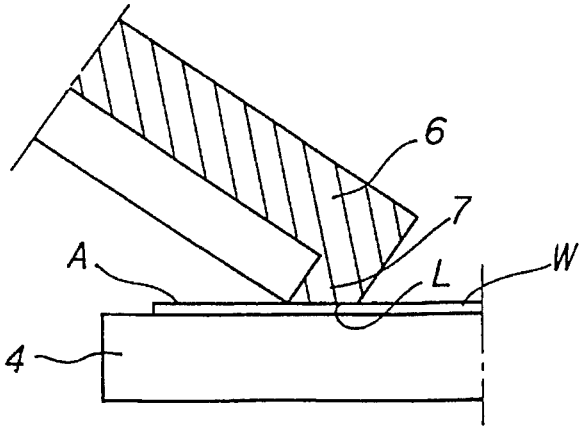
FIG. 2 is an explanatory view of an important part of the grinding machine according to this invention.

In addition, besides a cup type grinding stone 6 is integrally attached to the forward end of the above-mentioned grinding stone shaft 5 so as to mutually face the above-mentioned chuck 4, a taper-shaped conical portion 7 is provided at the forward end of the cup type grinding stone 6 by cutting out a part of its forward end outer peripheral face, and such a conical portion 7 is formed such that its generating line L contacts with the grinding surface A of the above-mentioned work W in parallel as shown in FIG. 2.

Figure 3A:
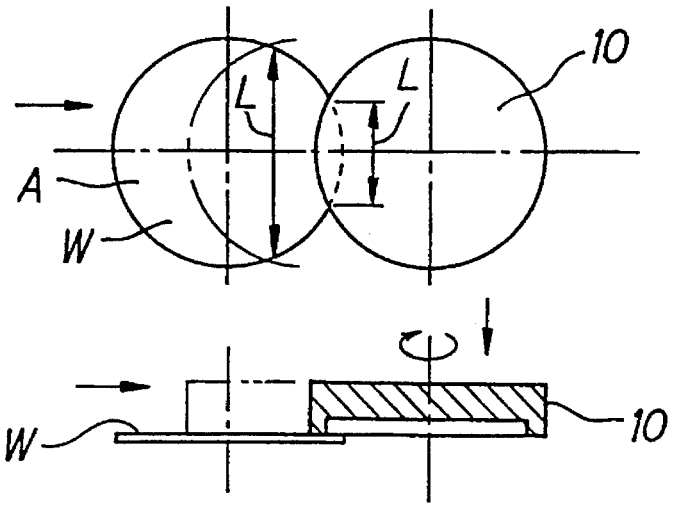
FIG. 3 is an explanatory view for explaining the conventional creep feed grinding and the work rotation grinding.
Figure 3B:
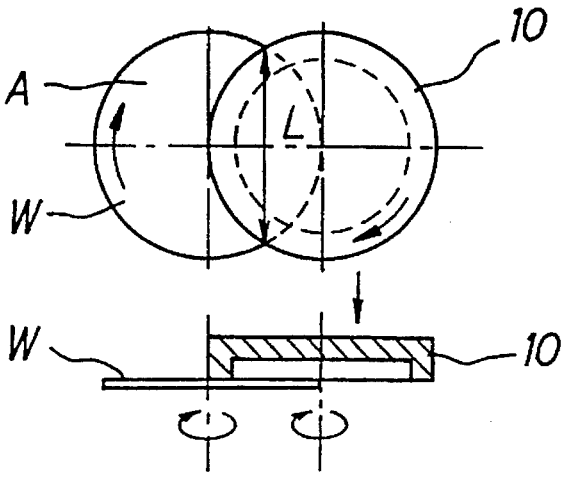

Incidentally, the conical portion 7 as described above can be easily formed using a dress member 8 installed on the reciprocating table 2. Namely, when the conical portion 7 is formed, after a new cup type grinding stone 6 as shown by phantom lines in FIG. 3 is attached to the grinding stone shaft 5, while moving the reciprocating table 2, the setting is performed so as to locate a forward end corner portion *6a* of the cup type grinding stone 6 at the center of the dress member 8. In this state, while have the reciprocating table 2 reciprocate rightward have and leftward, have the grinding stone shaft 5 lower toward the side of the reciprocating table 2 at a predetermined cutting speed. By doing so, the conical portion 7 contacting with the work W in line state as described above is formed in the cup type grinding stone 6. In addition, other than the working to form the conical portion 7 in the cup type grinding stone 6, the dress member 8 can also perform the dressing working for the conical portion 7 in the same working procedure as described above.

Next, the operation of the grinding machine constituted as described above will be explained on the basis of FIG. 1 and FIG. 2. Incidentally, it is approved that the conical portion 7 has been formed beforehand at the forward end of the cup type grinding stone 6.

In the case of this grinding machine, after the work W is fixed to the chuck 4, while rotating the main shaft 3 and the grinding stone shaft 5, have the grinding stone shaft 5 lower at a predetermined cutting speed toward the side of the work W along its shaft center direction (the direction of the arrow (β) in the figure). Simultaneously, have the reciprocating table 2 reciprocate. By doing so, the grinding surface A of the work W, for which the conical portion 7 of the cup type grinding stone 6 always contacts in the state of line-contact, and is ground by the portion of the conical portion 7.

Therefore, according to the grinding machine of the embodiment as described above, when the grinding surface of the work is ground using the cup type grinding stone, the conical portion of the cup type grinding stone always contacts with the grinding surface of the work in the state of line-contact, so that the grinding load inflicted to the grinding stone shaft decreases, and to an extent of the bending deformation of the grinding stone shaft due to the grinding load also becomes small, the grinding surface of the work can be ground with a good degree of flatness.

Moreover, under the line-contact as described above, it is possible to prevent the grinding stone from the dragging of grinding stone particles fallen from the grinding stone, and not only the surface roughness of the grinding surface is improved, but also the grinding amount by one grinding stone particle of the grinding stone becomes small, so that even when a grinding stone of fine grinding stone particles is used, no clogging of the grinding stone occurs, and it is possible to prevent grinding burning of the work, so that it becomes possible to grind the work using the grinding stone of fine grinding stone particles, and it is possible to further contemplate the improvement in the surface roughness.

In addition, because the grinding load inflicted to the grinding stone shaft decreases as described above, it is possible to apply a thin grinding stone shaft having low rigidity, and to an extent of which, it is also possible to contemplate to make the whole apparatus compact.

In the grinding machine according to this invention, the grinding stone shaft is arranged to be inclined with respect to the grinding surface of the work fixed to the chuck as described above, and the cup type grinding stone attached to the forward end of the grinding stone shaft is provided with the conical portion capable of abutting to the grinding surface of the above-mentioned work, so that when the grinding surface of the work is ground using such a cup type grinding stone, the conical portion of the cup type grinding stone always contacts with the grinding surface of the work in the state of line-contact, so that the grinding load inflicted to the grinding stone shaft decreases, and to an extent of the bending deformation of the grinding stone shaft due to the grinding load also becomes small, the grinding surface of the work can be ground with a good degree of flatness.

Moreover, under the line-contact as described above, it is possible to prevent the grinding stone from the dragging of grinding stone particles fallen from the grinding stone, besides the surface roughness of the grinding surface is improved, the grinding amount by one grinding stone particle of the grinding stone becomes small, so that even when a grinding stone of fine grinding stone particles is used, no clogging of the grinding stone occurs, and since it is possible to prevent grinding burning of the work, it becomes possible to grind the work using the grinding stone of fine grinding stone particles, and it is possible to further contemplate the improvement in the surface roughness.

What is claimed is:

1. A grinding machine for grinding a workpiece, comprising: first driving means for rotationally driving a workpiece having a work surface about a first axis; moving means for reciprocally moving the workpiece along a reciprocating axis perpendicular to the first axis; and second driving means for rotationally driving a grinder having a grinding surface about a second axis extending at an inclination angle to the first axis, and for moving the grinding surface of the grinder towards and away from the work surface of the workpiece along the second axis.

2. A grinding machine as claimed in claim 1; wherein the inclination angle is less than or equal to 5 degrees.

3. A grinding machine as claimed in claim 1; wherein the moving means comprises a fixed base, and a table movably disposed on the fixed base to undergo reciprocal movement relative to the fixed base along the reciprocating axis perpendicular to the first axis.

4. A grinding machine as claimed in claim 3; wherein the first driving means comprises a shaft rotatably disposed on the table to undergo rotation relative to the table about the first axis, and holding means for holding the workpiece and connected to the first rotating shaft for rotation therewith.

5. A grinding machine as claimed in claim 4; wherein the holding means comprises a vacuum chuck.

6. A grinding machine as claimed in claim 1; wherein the second driving means comprises a shaft rotatably supported for rotation about the second axis and supported for reciprocal movement towards and away from the workpiece along the second axis.

7. A grinding machine as claimed in claim 1; wherein the grinding surface of the grinder comprises a conically tapered portion shaped to make line contact with the work surface of the workpiece during use of the grinding machine.

8. A grinding machine as claimed in claim 1; further comprising dressing means for dressing the grinding surface of the grinder.

9. A grinding machine as claimed in claim 8; wherein the dressing means is connected to the moving means for reciprocal movement therewith.

10. A grinding machine for grinding a workpiece, comprising: a fixed base: a table movably disposed on the fixed base to undergo reciprocal movement relative to the fixed base along a reciprocating axis; a first shaft rotatably disposed on the table to undergo rotation relative to the table about a first axis extending perpendicular to the reciprocating axis; holding means for holding a workpiece and connected to the first shaft for rotation therewith; a second shaft rotatably supported for rotation about a second axis extending at an inclination angle to the first axis, and supported for reciprocal movement towards and away from the workpiece along the second axis; and a grinder having a grinding surface and connected to the second shaft for rotation therewith and for reciprocal movement of the grinding surface towards and away from a work surface of the workpiece.

11. A grinding machine as claimed in claim 10; wherein the holding means comprises a vacuum chuck.

12. A grinding machine as claimed in claim 11; wherein the workpiece is wafer-shaped and has a first surface connected to the vacuum chuck and a second surface defining the work surface.

13. A grinding machine as claimed in claim 10; wherein the inclination angle is less than or equal to 5 degrees.

14. A grinding machine as claimed in claim 10; wherein the grinding surface of the grinder comprises a conically tapered portion shaped to make line contact with the work surface of the workpiece during use of the grinding machine.

15. A grinding machine as claimed in claim 14; wherein the inclination angle is less than or equal to 5 degrees.

16. A grinding machine as claimed in claim 14; wherein the grinder comprises a cup-type grinding stone.

17. A grinding machine as claimed in claim 16; wherein the inclination angle is less than or equal to 5 degrees.

18. A grinding machine as claimed in claim 10; wherein the grinder comprises a cup-type grinding stone.

19. A grinding machine as claimed in claim 10; wherein the workpiece is wafer-shaped and has a first surface connected to the holding means and a second surface defining the work surface.

20. A grinding machine as claimed in claim 10; further comprising dressing means connected to the moving means for reciprocal movement therewith for dressing the grinding surface of the grinder.

* * * * *